US008781147B1

(12) United States Patent
Giuroiu

(10) Patent No.: US 8,781,147 B1
(45) Date of Patent: Jul. 15, 2014

(54) ACOUSTIC HEADPHONE HAVING A SINGLE INTERFACE TO RECEIVE AUDIO SIGNALS AND CONFIGURATION DATA

(75) Inventor: Horia Giuroiu, Campbell, CA (US)

(73) Assignee: National Acquisition Sub, Inc., Santa Clara, CA (US)

( * ) Notice: Subject to any disclaimer, the term of this patent is extended or adjusted under 35 U.S.C. 154(b) by 523 days.

(21) Appl. No.: 12/478,745

(22) Filed: Jun. 4, 2009

Related U.S. Application Data

(60) Provisional application No. 61/058,724, filed on Jun. 4, 2008.

(51) Int. Cl.
*H04R 25/00* (2006.01)
*H04R 1/10* (2006.01)
*H04R 5/02* (2006.01)

(52) U.S. Cl.
USPC ..... 381/384; 381/74; 381/309

(58) Field of Classification Search
USPC ..... 381/74, 309, 58, 26, 384, 66; 455/575.2; 379/406.01–406.16; 370/286, 289
See application file for complete search history.

(56) References Cited

U.S. PATENT DOCUMENTS

| | | | | |
|---|---|---|---|---|
| 4,656,620 | A * | 4/1987 | Cox | 370/536 |
| 4,740,963 | A * | 4/1988 | Eckley | 370/522 |
| 2005/0010269 | A1 * | 1/2005 | Lebel et al. | 607/60 |
| 2006/0013413 | A1 * | 1/2006 | Sakaidani | 381/104 |

* cited by examiner

*Primary Examiner* — Daniel Luke
*Assistant Examiner* — Khaja Ahmad
(74) *Attorney, Agent, or Firm* — Andrew Viger; Frederick J. Telecky, Jr.

(57) ABSTRACT

An interface between a programming system and a set of headphones allows the transmission of both audio and digital data over analog audio signal lines of the headphones. Circuitry on the programming system is configured to transmit digital data over the analog audio signal lines by either modulating a carrier frequency with the digital data such that the digital data is transmitted over non-audible frequencies or by time-multiplexing the transmission of digital data and analog audio data. Circuitry on the headphones is configured to receive digital data by demodulating the modulated digital data or by de-multiplexing the time-multiplexed digital and analog audio data. In other embodiments of acoustic headphones which include microphones, a Talk-Through functionality may be implemented.

9 Claims, 13 Drawing Sheets

ACOUSTIC HEADPHONE HAVING A SINGLE INTERFACE TO RECEIVE AUDIO SIGNALS AND CONFIGURATION DATA

CROSS-REFERENCE TO RELATED APPLICATION

This application claims the benefit under 35 USC 119(e) of the co-pending and commonly owned U.S. Provisional Application No. 61/058,724 entitled "ANC-Proposal For Merging The Analog And Digital Interfaces" filed on Jun. 4, 2008, which is incorporated by reference herein.

FIELD OF INVENTION

The present invention relates generally to transmission of digital data over analog signal lines and more specifically to the transmission of digital data over analog audio signal lines for use in audio headphones.

DESCRIPTION OF RELATED ART

Increasingly, audio headphones are incorporating digital circuitry onboard. For example, noise-cancelling headphones contain Active Noise Cancellation (ANC) circuitry. Such ANC circuitry often requires testing, programming, and calibration after assembly of the noise-cancelling headphones is complete. In most instances, testing, programming, and calibrating the ANC circuitry require digital configuration data to be sent to the ANC circuitry. On the other hand, audio headphones typically only have two analog signal lines that can be easily accessed—the right and left audio channels. Thus, in order to program, test or calibrate the ANC circuitry within noise-cancelling headphones, it is often necessary to provide additional digital input and output (I/O) interfaces (e.g. pins and connectors) on the headphones to transfer the digital configuration data.

For example, FIG. 1 illustrates a prior art acoustic system. Acoustic system 100 includes programming system 101 coupled to headphones 110 through analog connector 104 for transmitting analog audio data and digital interface 105 for transmitting configuration data. Programming system 101 includes circuitry to generate analog audio signals, as well as digital configuration data, to be output to the headphones 110. The analog connector 104 interfaces signal lines IN_R, IN_L, and GND with the headphones 110. IN_R and IN_L correspond to right and left audio channel data, respectively. GND is a ground line. Programming system 101 outputs IN_R, IN_L, and GND via audio output ports 102. The digital configuration data is transferred from the programming system 101 to the headphones 110 via two dedicated digital signal lines, SDA and SCLK. SDA and SLCK are output from the programming system via digital output ports 103. SDA and SLCK signal lines require a dedicated digital interface 105 on the headphones in order to interface with circuitry within the headphones 110.

Additional I/O interfaces dedicated to providing digital testing and programming signals to the headphones undesirably increase manufacturing costs and increase headphone size. Some headphones, such as in-ear headphones (sometimes referred to as ear-buds), are too small to include an additional I/O interface dedicated to receive digital configuration data.

BRIEF DESCRIPTION OF THE DRAWINGS

The features and advantages of the present invention are illustrated by way of example and are by no means intended to limit the scope of the present invention to the particular embodiments shown, and in which.

DETAILED DESCRIPTION

A method and apparatus for transferring digital configuration data for use in programming, testing, and/or calibrating circuitry within a pair of headphones through one or more analog audio signal lines are described below. Although described with respect to testing and programming ANC circuitry within noise-cancelling headphones, the embodiments herein may be similarly applied to any headphones containing circuitry that allow digital input signals. In the following description, for purposes of explanation, specific nomenclature is set forth to provide a thorough understanding of the present invention. However, it will be apparent to one skilled in the art that these specific details may not be required to practice the present invention. In other instances, well-known circuits and devices are shown in block diagram form to avoid obscuring the present invention unnecessarily. Additionally, the interconnection between circuit elements or blocks may be shown as buses or as single signal lines. Each of the buses may alternatively be a single signal line, and each of the single signal lines may alternatively be buses. Additionally, the logic states of various signals described herein are exemplary and therefore may be reversed or otherwise modified as generally known in the art.

In headphones containing circuitry that receive digital data as input signals, certain embodiments allow digital data to be transferred over two audio signal lines which are typically used to transfer audio data for the left and right audio channels. By transferring digital data over existing analog signal lines, the need for separate digital I/O interfaces on the headphones may be obviated, thereby lowering the cost and simplifying the design of the headphones.

A specific embodiment allows for digital data to be sent concurrently with analog audio data through audio cables. According to another embodiment, digital data and analog audio data are transmitted at separate time intervals. According to yet another embodiment, detection circuitry within the headphones is configured to detect the presence of digital signals in the analog signal lines. In response to detecting digital signals in the analog signal lines, the detection circuitry may activate other circuitry to process the digital signals.

Figure 1:
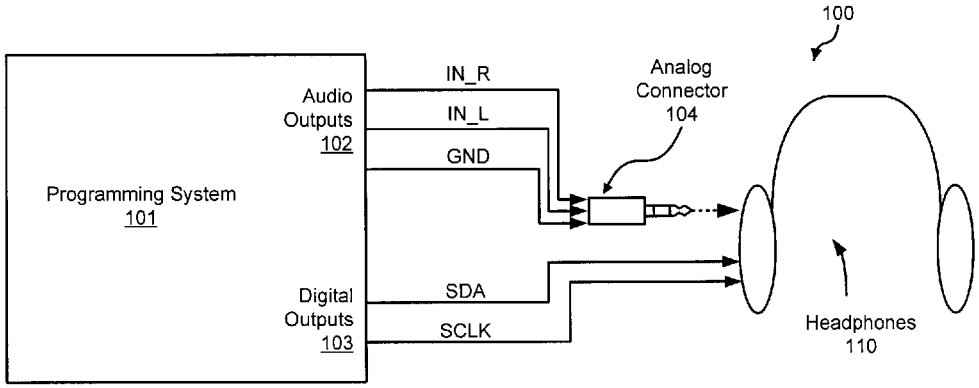
FIG. 1 (Prior Art)
FIG. 1 illustrates a prior art acoustic system.
Figure 2:
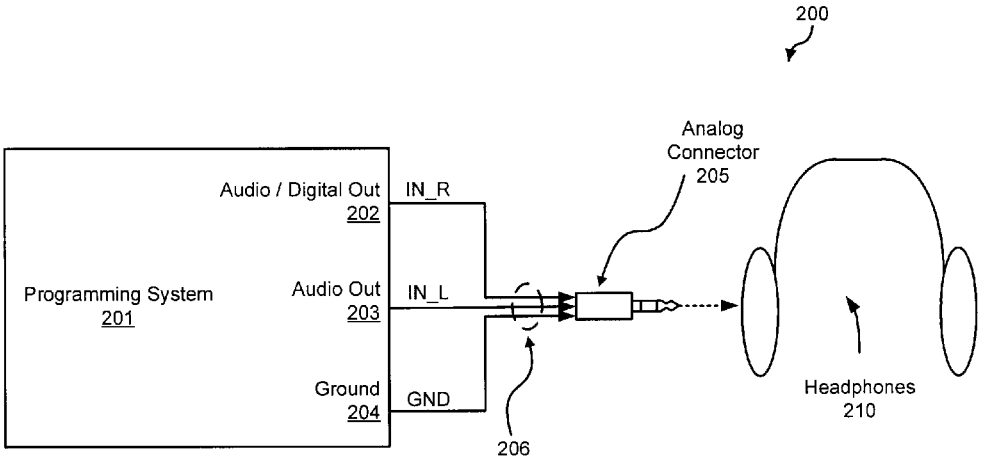
FIG. 2 illustrates an acoustic system according to an embodiment.

FIG. 2 illustrates an acoustic system according to an embodiment. Acoustic system 200 includes programming system 201 coupled to headphones 210 through an audio cable 206 for transmitting analog audio data and digital configuration data. Programming system 201 includes circuitry to generate analog audio signals, as well as digital configuration data, to be output to the headphones 210 via audio cable 206 and analog connector 205. Audio cable 206 includes left and right audio channels (IN_L and IN_R), and a ground signal line (GND). Programming system 201 may output audio signals over IN_R, IN_L, and GND via audio/digital output port 202, audio output port 203, and ground port 204, respectively. In certain modes of operation, both digital configuration data and analog audio signals may be transmitted over IN_R. It should be noted that aspects of the present embodiment are similarly applicable to IN_L. For example, IN_L may be also be configured to carry both digital configuration data and analog audio signals.

According to an embodiment, the analog connector 205 is a standard tip, ring, sleeve (TRS) connector. For example, the headphones may contain a female TRS connector input, and the analog connector 205 may thus be a male TRS connector. According to another embodiment, the audio cable is attached to the housing of the headphones 210 without a removable connector.

With respect to the headphones 210 of FIG. 2, no additional I/O interfaces, aside from the ones shown for transferring analog audio signals, are needed to communicate digital configuration data from the programming system 201 to the headphones 210.

Figure 3:
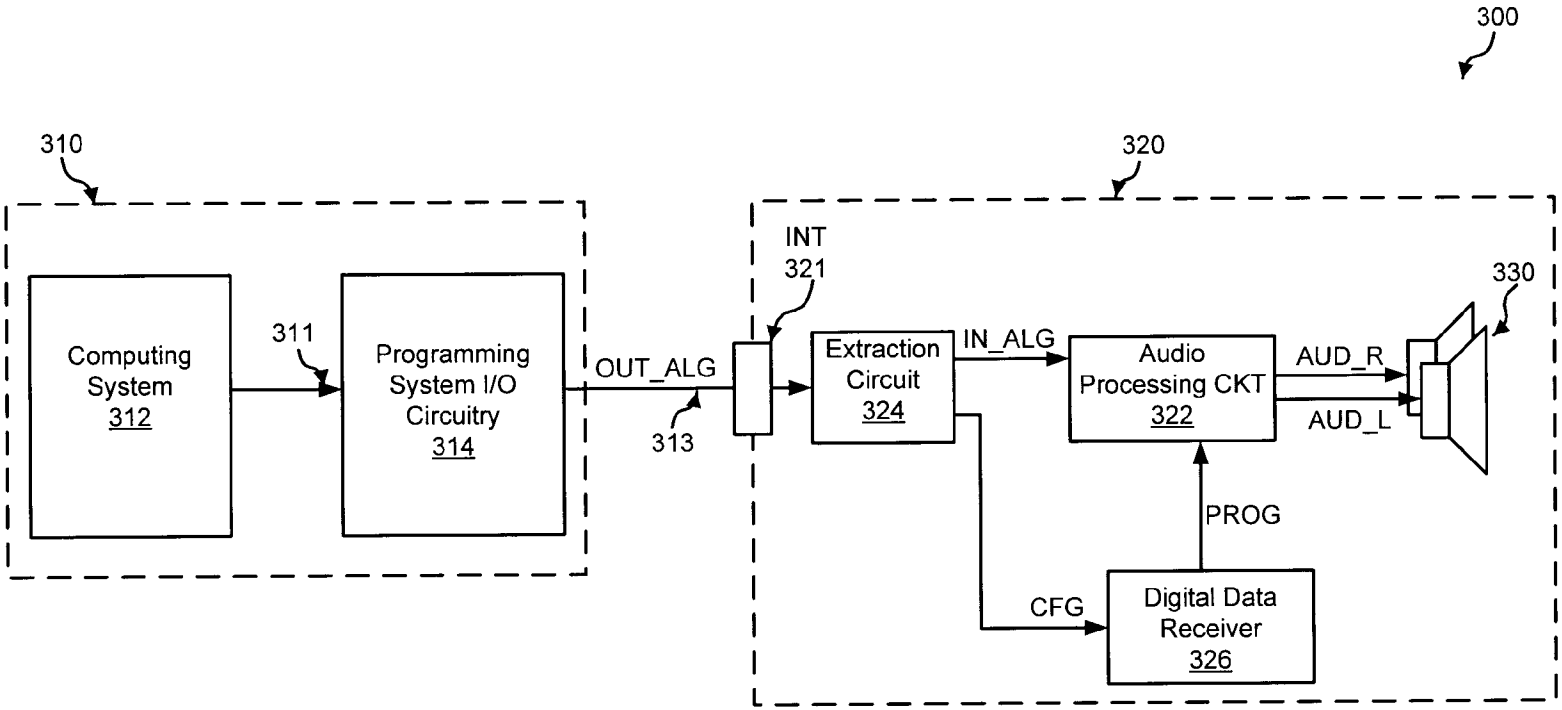
FIG. 3 is a functional block diagram illustrating a more detailed embodiment of the programming system 201 and headphones 210 of FIG. 2.

FIG. 3 is a functional block diagram illustrating a detailed embodiment of the programming system 201 and headphones 210 of FIG. 2. Acoustic system 300 includes programming system 310 and headphones 320, which represent detailed embodiments of programming system 201 and headphones 210, respectively. The programming system 310 includes computing system 312, and I/O circuitry 314. The computing system 312 may be a personal computer or any other system or device that generates data to be output by the I/O circuitry 314 to the headphones 320.

Programming system I/O circuitry 314 has an input to receive data from the computing system 312 via signal line 311. Received data may include digital configuration data in addition to analog audio signals. Programming system I/O circuitry 314 has one or more outputs to transmit an output analog signal (OUT_ALG) via signal line 313. According to at least one embodiment, OUT_ALG is a stereo signal to be transmitted across left and right audio channels. The left and right audio channels correspond to IN_L and IN_R, respectively, of FIG. 2. According to another embodiment, OUT_ALG is a mono signal representing a single audio channel. In an audio-only mode of operation of the acoustic system 300, OUT_ALG consists of only analog audio signals. In other modes of operation of the acoustic system 300, OUT_ ALG includes digital configuration data in addition to analog audio signals.

Headphones 320 includes interface 321, audio processing circuit 322, extraction circuit 324, digital data receiver 326, and speakers 330. Interface 321 has an input which may be coupled to signal line 313 to receive OUT_ALG from the programming system 310. Interface 321 provides OUT_ALG to extraction circuit 324. Extraction circuit 324 extracts the digital configuration data from OUT_ALG and outputs a configuration signal (CFG) to digital data receiver 326 and an analog audio signal (IN_ALG) to audio processing circuit 322. Digital data receiver 326 has an input to receive the CFG signal and an output to transmit programming data (PROG) to the analog audio processing circuit 322 to adjust the performance or operation of the audio processing circuit 322. Digital data receiver 326 may include configuration registers and/or configuration circuits. The received CFG signal may be used by the digital data receiver to program the configuration registers and cause the configuration circuits to update or generate the PROG signal to be provided to the audio processing circuit 322. Audio processing circuit 322 has inputs to receive IN_ALG and PROG and outputs to transmit right and left audio channel signals (AUD_R and AUD_L) to speakers 330. Audio processing circuit 322 has one or more adjustable or programmable functionalities which is dependent on the PROG signal from the data receiver.

Figure 4A:
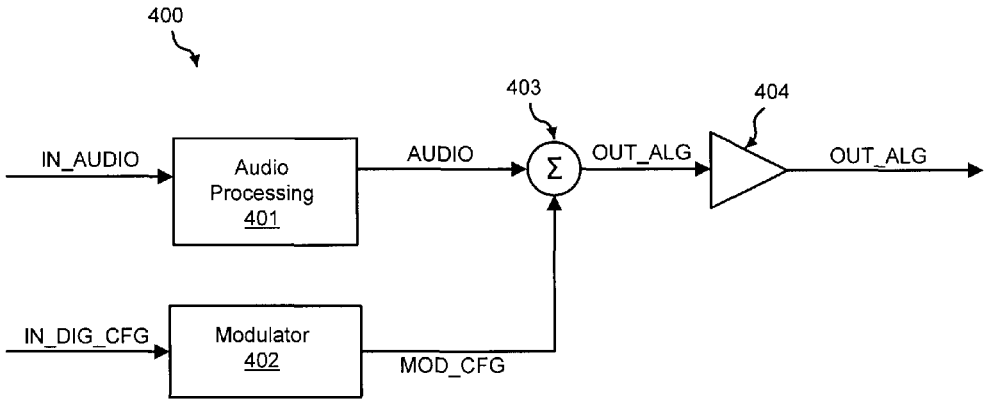
FIG. 4A is a functional block diagram of the programming system I/O circuitry of FIG. 3, according to an embodiment.

FIG. 4A is a functional block diagram of the programming system I/O circuitry 314 of FIG. 3. I/O circuitry 400 includes audio processing block 401, modulator 402, signal combination element 403, and output buffer 404. Audio processing block 401 has an input to receive an input audio signal (IN_AUDIO). Modulator 402 has an input to receive input digital configuration data (IN_DIG_CFG). Referring back to FIG. 3A-3C, IN_AUDIO and IN_DIG_CFG are both transmitted via signal line 311 by the computing system 312. Audio processing block 401 generates an analog output audio signal (AUDIO) from IN_AUDIO. IN_AUDIO is an audio signal which may be in digital or analog form. If in digital form, audio processing block 401 is configured to perform digital-to-analog conversion to generate AUDIO. In generating AUDIO, audio processing block 401 may modify IN_AUDIO by well-known means of audio signal processing in either the analog or digital domain. For example, the frequency of AUDIO may range from 20 Hz to 20 kHz (e.g., the human-audible frequency range). According to an alternative embodiment, the audio signal may be generated by an audio signal generator within the I/O circuitry 400, independent of data from the computing device 310.

IN_DIG_CFG may represent programming, testing, and/or calibration data used for configuring circuitry within acoustic headphones. IN_DIG_CFG may be provided as a digital data stream. Modulator 402 modulates a carrier wave with IN_DIG_CFG using any of the well-known modulation schemes, such as frequency-shift keying (FSK) or phase-shift keying (PSK), to generate a modulated configuration signal (MOD_CFG). MOD_CFG is an analog signal (as a result of the modulation) containing digital data. The modulated signal is then outputted from modulator 402. According to an embodiment, the frequency of MOD_CFG is higher than that of the analog audio signals. Thus, in the frequency domain, MOD_CFG does not overlap with signals in the audible frequency range. Since MOD_CFG is transmitted to the headphones via audio cables, the frequencies of MOD_CFG may be low enough to prevent parasitic capacitances, inductances, and resistances of audio cables from degrading MOD_CFG significantly. When operating in an audio-only mode, modulator 402 may remain in an OFF or standby state to conserve power.

MOD_CFG and AUDIO are transmitted to signal combination element 403 which combines the two signals into a single analog signal for output (i.e., output analog signal OUT_ALG). OUT_ALG is an analog signal that has two components: (i) one representing analog audio signal (AUDIO), and (ii) one representing modulated configuration signal (MOD_CFG). Since AUDIO and MOD_CFG do not overlap in frequency domain, either signal can be retrieved by filtering the combined signal (OUT_ALG) by an appropriate high, low, or band-pass filter. From the signal summation element 403, OUT_ALG is transmitted to an output buffer. The output buffer provides adequate drive strength of the combined signal to be transmitted through a long conductor line coupling I/O circuitry 400 with the headphones. Output buffer 404 also prevents loading of components of the I/O circuitry 400, such as modulator 402, by the line capacitance and resistance of the conductor line.

Figure 4B:
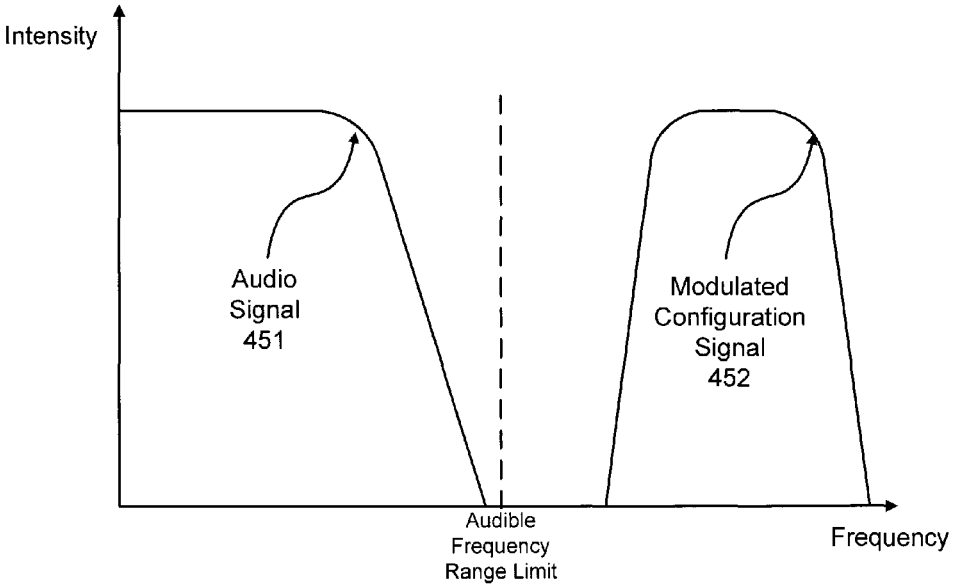
FIG. 4B is a frequency domain plot of the output analog signal shown in FIG. 4A.

FIG. 4B is a frequency domain plot of OUT_ALG as shown in FIG. 4A. The X-axis represents frequency, and the Y-axis represents signal intensity. OUT_ALG includes two signal components: (i) an audio signal 451 and (ii) a modulated configuration signal 452. Referring back to FIG. 4A, the audio signal 451 is generated by audio processing block 401 (AUDIO) and modulated configuration signal 452 is generated by modulator 402 (MOD_CFG). The two signals are combined by signal combination element 403 as OUT_ALG. Audio signal 451 ranges in frequency, for example, from 20 Hz to 20 kHz. In the example shown, the modulated CFG 452 has a bandwidth that is higher than the audible frequency limit.

Figure 5:
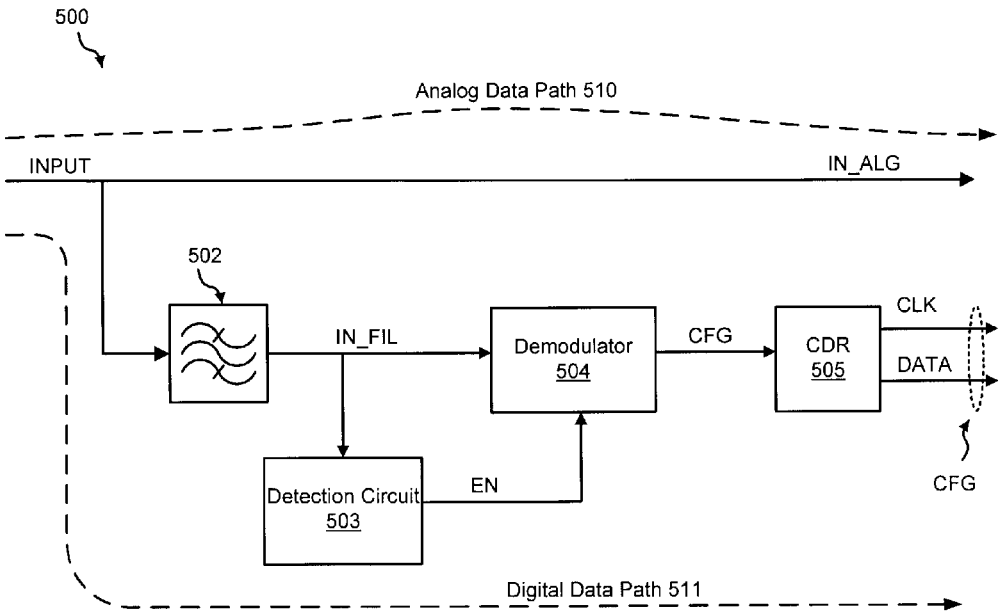
FIG. 5 is a functional block diagram illustrating a detailed embodiment of the extraction circuit of FIG. 3.

FIG. 5 is a functional block diagram illustrating a detailed embodiment of the extraction circuit 324 of FIG. 3. Extraction circuit 500 is configured to extract analog audio data and digital configuration data from an analog input generated by programming system I/O circuitry 400 of FIG. 4. Extraction circuit 500 has an input to receive an input signal (INPUT), a first output to transmit an analog signal (IN_ALG), and a second output to transmit digital configuration data (CFG). For at least certain modes of operation, INPUT signal includes an analog audio component and a modulated configuration data component. The analog audio component and the modulated configuration component reside in different frequency ranges, and each of the two components may be recovered by filtering. Referring back to FIG. 3, the input of extraction circuit 500 may be coupled to the interface 321 to receive OUT_ALG from programming system I/O circuitry 314 as INPUT. The first output may be coupled to transmit IN_ALG to audio processing circuit 322, and the second output may be coupled to transmit CFG to digital data receiver 326.

The signal path between INPUT and IN_ALG forms an analog data path 510. In this analog data path 510, the analog audio component of INPUT is propagated forward and outputted as IN_ALG; whereas the modulated configuration data component may be attenuated or filtered out. Although not shown on FIG. 5, one or more filters may be utilized on the analog data path 510 to attenuate or filter signals in the non-audio frequency range. Analog signal path 510 may also contain signal processing elements (not shown in FIG. 5) which perform audio signal processing on signals in the analog signal path 510.

Extraction circuit 500 includes filter 502, detection circuit 503, demodulator 504, and clock and data recovery (CDR) 505. The filter 502, detection circuit 503, demodulator 504, and CDR 505 form a signal path for digital data. In this digital data path, the signal corresponding to configuration data is propagated forward, while the analog audio component of INPUT is attenuated or filtered out. Filter 502 may be a band-pass or high-pass filter, which generates a filtered signal (IN_FIL) by filtering out any signals with frequencies in the audible frequency range (e.g., between 20 Hz and 20 kHz). A buffer may be placed in the digital data path before the filter 502 to prevent loading of the input signal line by the filter 502. IN_FIL is transmitted to detection circuit 503 and demodulator 504.

In audio-only headphone operations, the demodulator 504 may be in a standby or off state to reduce power consumption and is enabled when a modulated configuration signal in IN_FIL is detected by the detection circuit 503. The detection circuit 503 detects the presence of the modulated configuration signal by measuring the power of signals around the carrier frequency of the modulated configuration signal. When the power of the modulated configuration signal reaches a certain threshold, the detection circuit 503 is configured to assert an enable signal (EN) provided to the demodulator 504 to cause the demodulator 504 to power on or exit a standby state (e.g., by returning to an active state). To prevent the loss of data during powering up of the demodulator 504, the programming system may be configured to precede the transmission of any digital configuration data with an un-modulated carrier signal, or a sequence of arbitrary bits of data (i.e. not associated with digital configuration data). The un-modulated carrier signal or the sequence of arbitrary bits of data is long enough in time duration to allow the demodulator 504 to power up or exit a standby mode. In certain embodiments, one or more delay elements may be provided between the filter 502 and the demodulator 504, to ensure that the output from the filter 502 does not arrive at the demodulator 504 before the demodulator 502 has successfully powered up or returned to an active state.

The demodulator 504 demodulates IN_FIL to generate a digital data stream of configuration data (CFG). CFG is output from the demodulator 504 to the CDR 505. The CDR 505, which is well-known, generates a clock signal from a frequency reference and realigns transitions of the digital data stream with the generated clock signal. The CDR 505 outputs the generated clock signal (CLK) and the realigned digital data (DATA). CLK and DATA together represent the CFG signal. Similar to the demodulator 504, the CDR circuitry 505 may be in a standby or off state during audio-only operations of the headphones. The CDR 505 may also receive an enable signal from the detection circuit 503 to cause CDR 505 to power up or exit a standby state.

Figure 6:
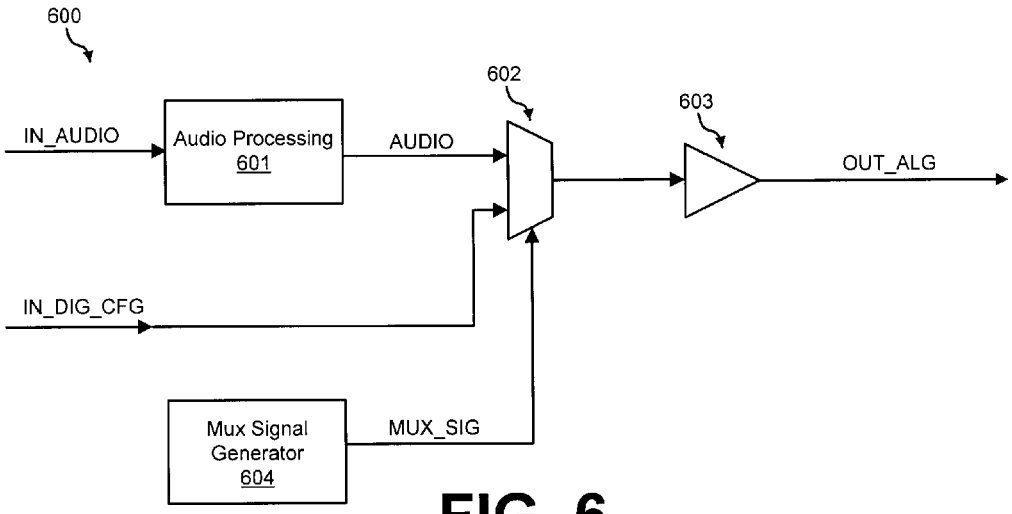
FIG. 6 is a functional block diagram of the programming system I/O circuitry of FIG. 3, according to another embodiment.

FIG. 6 is a functional block diagram of the programming system I/O circuitry 314 of FIG. 3, according to another embodiment. The programming system I/O circuitry 600 is configured to time-multiplex analog audio and digital signals such that at any given time, only one of the analog audio or digital signals is transmitted over a signal line connecting the programming system to the headphones. By time-multiplexing (or interleaving) the analog audio signal and the digital signal, the programming system I/O circuitry is capable of transmitting digital signals with frequencies in the audio signal range without interfering with the audio signals. The programming system I/O circuitry 600 includes audio processing block 601, multiplexer 602, output buffer 603, and multiplex signal generator 604.

The audio processing block 601, which may be functionally similar to the audio processing block 401 of FIG. 4A, receives an audio input (IN_AUDIO), which may be either in analog or digital form, and performs audio processing on IN_AUDIO to generate an analog audio signal (AUDIO) for output. A digital input (IN_DIG_CFG) received by the programming system I/O circuitry is coupled to the multiplexer. The multiplexer 602 time-multiplexes AUDIO with IN_DIG_CFG and is controlled by a multiplex signal (MUX_SIG) generated by the multiplex signal generator 604. The multiplexer allows AUDIO to pass through during one state (i.e. supply voltage or ground) of MUX_SIG signal, and allows IN_DIG_CFG to pass through during another state of the multiplex signal. The buffer 603 outputs the time-multiplexed signal to the headphones as OUT_ALG.

According to one embodiment, the multiplex signal generator 604 includes a signal detection mechanism to detect the presence of IN_DIG_CFG on the digital input signal line. Upon detecting the presence of digital data, the multiplex signal generator 604 sets the state of the multiplex signal to allow for the incoming digital data to pass through the multiplexer. According to another embodiment, the multiplex signal generator 604 generates a square-wave as the multiplex signal. Latches, registers or other storage elements may be present in the programming system I/O circuitry to temporarily store the incoming digital input when the multiplex signal is set to allow transmission of analog audio data through the multiplexer.

Figure 7:
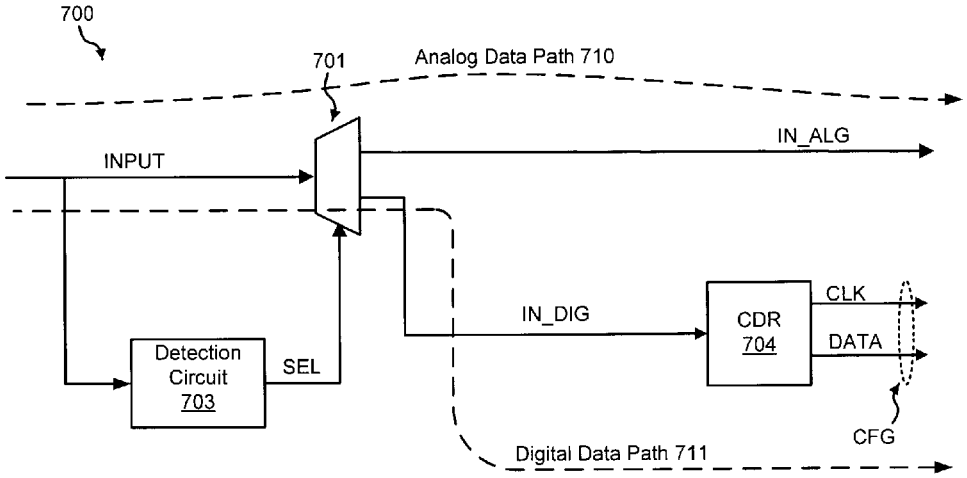
FIG. 7 is a functional block diagram illustrating another detailed embodiment of the extraction circuit of FIG. 3.

FIG. 7 is a functional block diagram illustrating another detailed embodiment of the extraction circuit 324 of FIG. 3. Extraction circuit 700 is configured to extract analog audio data and digital configuration data from an analog input signal generated by programming system I/O circuitry 600 of FIG. 6. Extraction circuit 700 has an input to receive an input signal (INPUT), a first output to transmit an analog signal (IN_ALG), and a second output to transmit digital configuration data (CFG). INPUT is a time-multiplexed combination of an analog audio signal and digital configuration data. Referring back to FIG. 3, the input of extraction circuit 700 may be coupled to the interface 321 to receive OUT_ALG from programming system I/O circuitry 314 as INPUT.

The signal path between INPUT and IN_ALG forms an analog data path 710. In this analog data path 710, analog audio signals of INPUT are propagated forward and output as IN_ALG; whereas digital configuration data of INPUT is not. The signal path between INPUT and CFG form a digital data path 711. In this data path, analog audio signals may be attenuated or filtered out, whereas digital configuration data is propagated forward.

Extraction circuit 700 includes de-multiplexer 701, detection circuit 703, and CDR 704. De-multiplexer 701 receives, as a first input, the time-multiplexed analog audio and digital signal generated by the programming system I/O circuitry 600 of FIG. 6. De-multiplexer 701 receives, as a second input, a select signal (SEL) from a detection circuit 703. Detection circuit 703 is also coupled to the input of the extraction circuit 700 and generates SEL based on the presence of digital data received in INPUT. When SEL is in a first state (supply voltage or ground), INPUT is determined to contain analog audio signal and de-multiplexer 701 allows INPUT to propagate on the analog data path 710. When the multiplex signal is a second state, INPUT is determined to contain digital configuration data and multiplexer 701 allows INPUT to propagate to CDR circuitry 704 as IN_DIG. CDR circuitry 704, operating in the same manner as CDR circuitry 505 of FIG. 5 generates a clock signal (CLK) and a digital data signal (DATA) which together form the output signal CFG.

Figure 8:
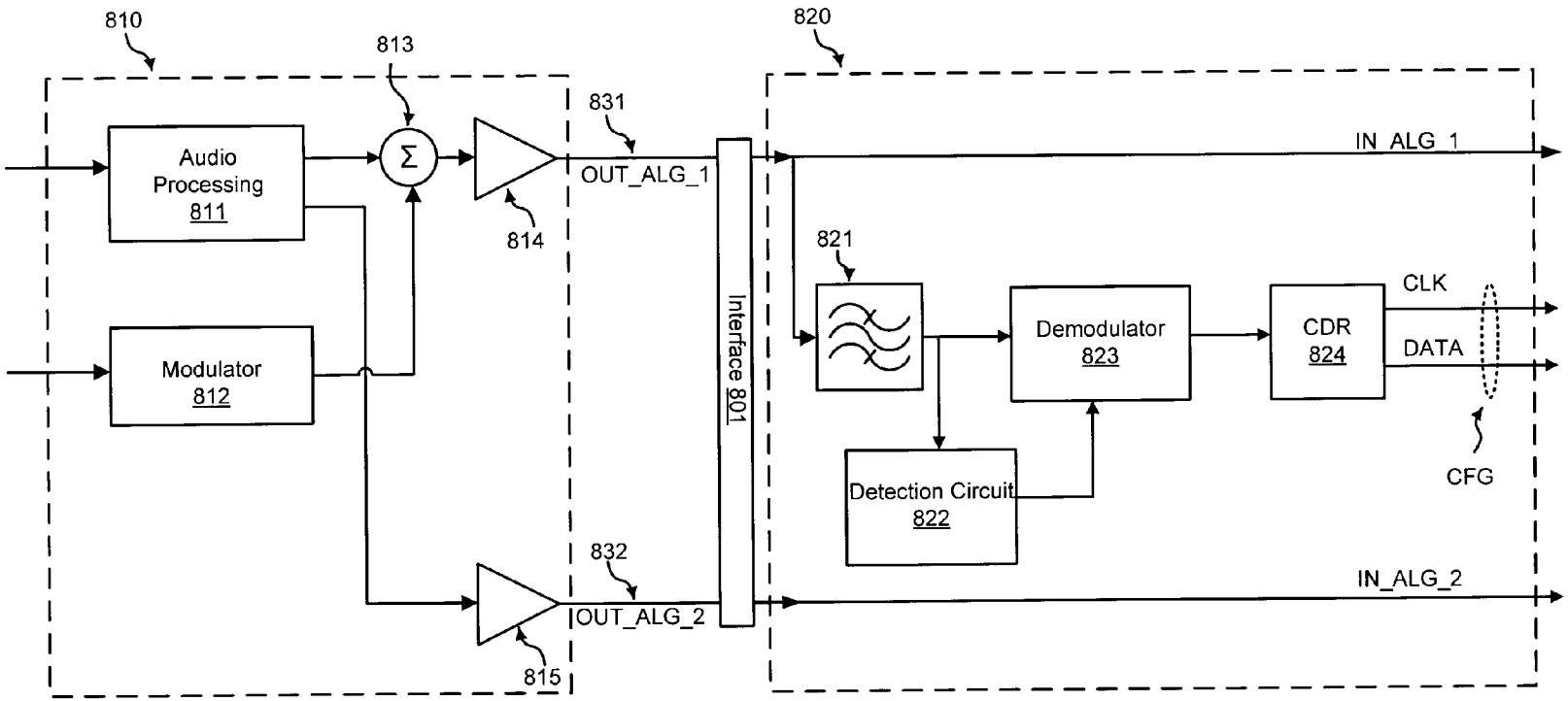
FIG. 8 is a functional block diagram showing an embodiment of the programming system I/O circuitry of FIG. 3 coupled to the extraction circuit via an interface.

FIG. 8 is a functional block diagram showing an embodiment of programming system I/O circuitry 314 of FIG. 3 coupled with an embodiment extraction circuit 324 of FIG. 3 through an interface 801. Programming system I/O circuitry 810, extraction circuit 820, and interface 801 form parts of the acoustic system including a programming system and a set of acoustic headphones. Programming system I/O circuitry 810 is coupled to extraction circuit 820 through signal lines 831 and 832 and interface 801. Interface 801 may, for example, correspond to interface 321 of FIG. 3, and signal lines 831 and 832 may collectively correspond to signal line 313. Additionally, OUT_ALG__1 and OUTALG__2 may collectively correspond to OUT_ALG of FIG. 3.

Signal line 831 is used to transmit audio and digital configuration data between the programming system and the headphones for at least some operations of the acoustic system, including ANC operations. Signal line 832 is used to transmit only audio data. During audio only operations of the headphones, such as when the headphones are connected to a media source supporting only analog audio output (MP3 player, computer etc.), only audio data is transmitted over signal lines 831 and 832.

The programming system I/O circuitry 810 may, for example, function similarly to any of the programming system I/O circuits described above (e.g., with respect to FIG. 4A or FIG. 6). The Extraction circuit 820 may, for example, function similarly to any of the extraction circuits described above (e.g., with respect to FIG. 5 or FIG. 7).

The programming system I/O circuitry 810 includes audio processing block 811, modulator 812, signal combination element 813, and output buffers 814 and 815. Programming system I/O circuitry 810 has a first input to receive audio data at the audio processing block 811, which generates two analog audio signals—corresponding to left and right audio channels. Programming system I/O circuitry 810 has a second input to receive digital configuration data at the modulator 812. A first of the two analog audio signals is transmitted to signal combination element 813. Modulator 812, signal combination element, and output buffer 814 may operate in a similar manner as described for corresponding elements of FIG. 4A, to generate an output signal (OUT_ALG__1) containing both an analog audio signal and a modulated configuration signal. OUT_ALG__1 is subsequently transmitted over the signal line 831. The second analog audio signal is transmitted to buffer 815, which transmits the second analog audio signal over the signal line 832 as OUT_ALG__2.

Extraction circuit 820 is coupled to receive OUT_ALG__1 and OUT_ALG__2 and output two analog audio signals (IN_ALG__1 and IN_ALG__2) and a digital data stream corresponding to configuration data (DATA) and a digital clock (CLK). IN_ALG__1 may correspond to IN_ALG of FIG. 3, and DATA and CLK may collectively correspond to CFG of FIG. 3. Extraction circuit 820 includes filter 821, detection circuit 822, demodulator 823, and CDR 824. Filter 821, detection circuit 822, demodulator 823, and CDR 824 may operate in a similar manner as described for corresponding elements of FIG. 5 to output IN_ALG__1, CLK, and DATA. In addition to the elements described in FIG. 5, extraction circuit 820 also receives analog audio signal OUT_ALG__2 and outputs OUT_ALG__2 as IN_ALG__2. Although not shown in FIG. 8, signal paths for transmitting IN_ALG__1 and IN_ALG__2 may contain audio signal processing elements to perform audio signal processing on IN_ALG__1 and IN_ALG__2.

Figure 9:
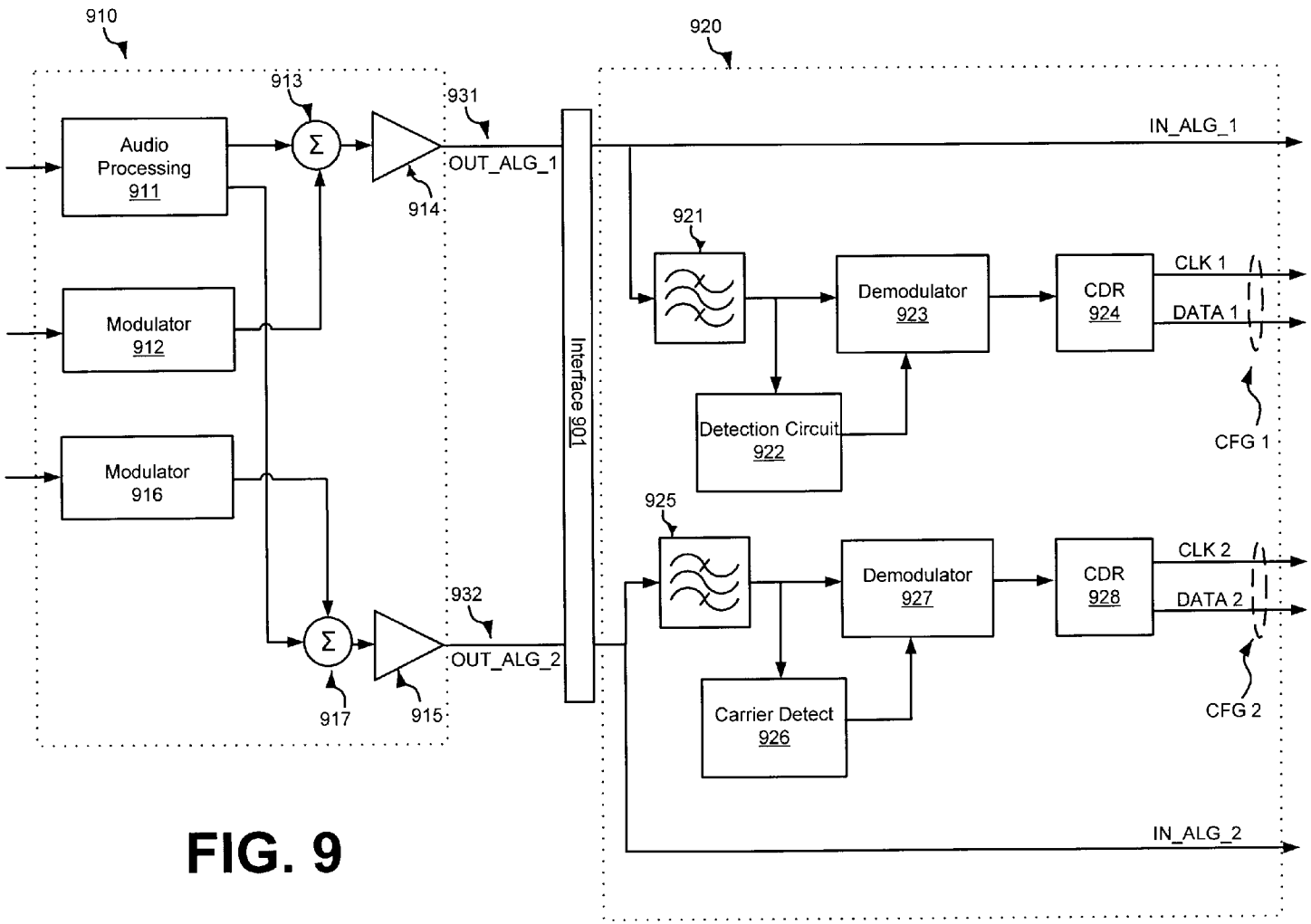
FIG. 9 is a functional block diagram showing an embodiment of a programming system I/O circuitry coupled to an extraction circuit.

FIG. 9 is a functional block diagram showing another embodiment of a programming system I/O circuitry coupled to an extraction circuit. Programming system I/O circuitry 910, extraction circuit 920, and interface 901 form parts of an acoustic system including a programming system and a set of acoustic headphones. Programming system I/O circuitry 910 is coupled to extraction circuit 920 via signal lines 931 and 932 and interface 901. Both signal lines 931 and 932 may be used to transmit audio and digital data during certain operations of the acoustic system, thereby increasing the data rate of the data signal. During audio-only operations of the headphones, such as when the headphones are connected to a media source supporting only supporting only analog audio output (MP3 player, computer etc.), only audio data is transmitted over signal lines 931 and 932.

The programming system I/O circuitry 910 may, for example, function similarly to any of the programming system I/O circuits described above (e.g., with respect to FIG. 4A or FIG. 6). The extraction circuit 920 may, for example, function similarly to any of the extraction circuits described above (e.g., with respect to FIG. 5 or FIG. 7).

Programming system I/O circuitry 910 is functionally similar to the programming system I/O circuitry 810 of FIG. 8, except with the additions of modulator 916 and signal combination element 923. Programming system I/O circuitry 910 includes audio processing block 911, modulators 912 and 916, signal combination elements 913 and 917, and output buffers 914 and 915. Programming system I/O circuitry 910 has a first input to receive audio data at the audio processing block 911, which generates two analog audio signals—corresponding to left and right audio channels. Programming system I/O circuitry 910 has a second input to receive a first digital configuration signal at the modulator 912. Programming system I/O circuitry 910 has a third input to receive a second digital configuration signal at the modulator 916.

Audio processing block 911, modulator 912, signal combination element 913, and output buffer 914 may operate in a similar manner as described above for corresponding elements described of FIG. 8, to generate combined analog and digital signals (OUT_ALG__1). OUT_ALG__1 is then output over the signal line 931 to the extraction circuit 920. Additional modulator 916 receives the second digital configuration signal as an input and generates a second modulated configuration signal. Signal combination element 917 combines the second modulated digital signal with a second analog audio signal received from the audio processing block 911. Output buffer 915 outputs the combined analog signal and modulate signal as OUT_ALG__2 on signal line 932. As described with respect to FIG. 8, the combination could be performed using frequency multiplexing or time multiplexing techniques. In the interface of FIG. 9, both signal lines 931 and 932 may transmit combined analog and digital signals. The two digital inputs to the programming system I/O circuitry (one being provided to each modulator) can correspond to separate digital data streams, or they may correspond to the same digital data stream.

Extraction circuit 920 functions similarly to the extraction circuit 820 of FIG. 8, except with the additions of filter 925, detection circuit 926, demodulator 927, and CDR 928. Filter 921, detection circuit 922, demodulator 923, and CDR 924 may operate in a similar manner as described above for corresponding elements of FIG. 5 and FIG. 8 to output a first analog audio output signal (IN_ALG__1), a first digital data stream corresponding to configuration data (DATA1), and a first clock signal (CLK1) based on OUT_ALG__1. Filter 925, detection circuit 926, demodulator 927, and CDR 928 operate in a similar manner as filter 921, detection circuit 922, demodulator 923, and CDR 924, respectively, to output a second analog audio output signal (IN_ALG__2), a second digital data stream corresponding to configuration data (DATA2), and a second clock signal (CLK2) based on OUT_ALG__2 received over signal line 932. According to the embodiment shown in FIG. 9, two digital data streams may be transmitted from the programming system I/O circuitry to the extraction circuit 902 in the headphones. Thus, the bandwidth of digital data transmission is effectively doubled.

Figure 10:
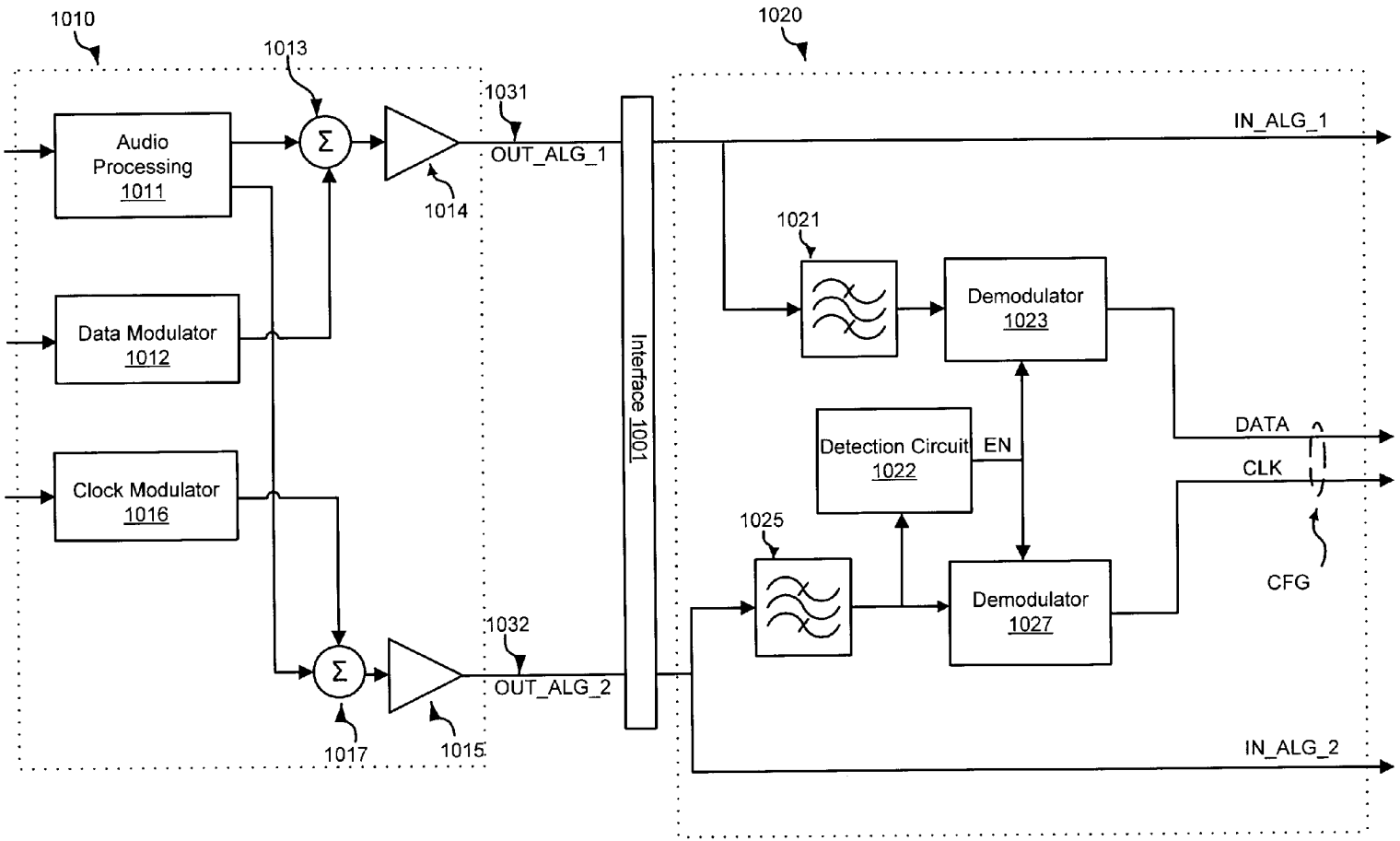
FIG. 10 is a functional block diagram showing an embodiment of a programming system I/O circuitry coupled to an extraction circuit utilizing separate signal lines for clock and digital data.

FIG. 10 is a functional block diagram showing an embodiment of a programming system I/O circuitry coupled to an extraction circuit utilizing separate signal lines for clock and digital data. Programming system I/O circuitry 1010, extraction circuit 1020, and interface 1001 form parts of the acoustic system including a programming system and a set of acoustic headphones. Programming system I/O circuitry 1010 is coupled to extraction circuit 1020 via signal lines 1031 and 1032 and interface 1001. Signal line 1031 is capable of transmitting a first analog audio signal and digital configuration data. Signal line 1032 is capable of communicating a second analog audio signal and a digital clock signal. The transmission of data and clock on separate signal lines eliminates the need for CDR in the I/O circuitry of the headphones.

Programming system I/O circuitry 1010 includes audio processing block 1011, data modulator 1012, clock modulator 1016, signal combination elements 1013 and 1017, and output buffers 1014 and 1015. Programming system I/O circuitry 1010 has a first input to receive audio data at the audio processing block 1011 to generate two analog audio signals—corresponding to left and right audio channels. Programming system I/O circuitry 1010 has a second input to receive digital configuration data at the data modulator 1012. Programming system I/O circuitry has a third input to receive a clock signal at the clock modulator 1016. Data modulator 1012, signal combination element 1013, and output buffer 1014 may operate in a similar manner as described above for corresponding elements of FIG. 8 and FIG. 9, to output a combined analog audio and modulated data signal (OUT_ALG__1) based on a first of the two analog audio signals and digital configuration data. Clock modulator 1016, signal combination element 1017, and output buffer 1015 operate to output a combined analog audio signal and modulated clock signal (OUT_ALG__2) based on the second of the two analog audio signals and the clock signal.

Extraction circuit 1020 includes filters 1021 and 1025, demodulators 1023 and 1027, and carrier detect block 1022. Filter 1021, which may function in a similar manner as filters 810 and 910 of FIG. 8 and FIG. 9, respectively, operates to eliminate signal components in the analog audio frequency range (e.g., 20 Hz to 20 kHz) and outputs a filtered signal to demodulator 1023. Demodulators 1023 and 1027 are controlled by enable signal (EN) from detection circuit 1022 and are in standby or off states when no modulated clock signal is being received over signal line 1032. Detection circuit 1022 asserts EN upon detecting the presence of the modulated clock signal from the output of filter 1025. The asserted enable signal causes demodulators 1023 and 1027 to power up or exit standby states. When the enable signal is asserted, demodulator 1023 demodulates modulated digital data signal from filter 1032 and outputs digital configuration data (DATA).

Filter 1027 receives OUTALG__2, and outputs modulated clock signal to both detection circuit 1022 and demodulator 1027. When EN from detection circuit 1022 is asserted, demodulator 1027 demodulates modulated clock signal and outputs a clock signal (CLK). DATA and CLK are transmitted to appropriate circuitry within the headphones for use with configuration data.

Figure 11:
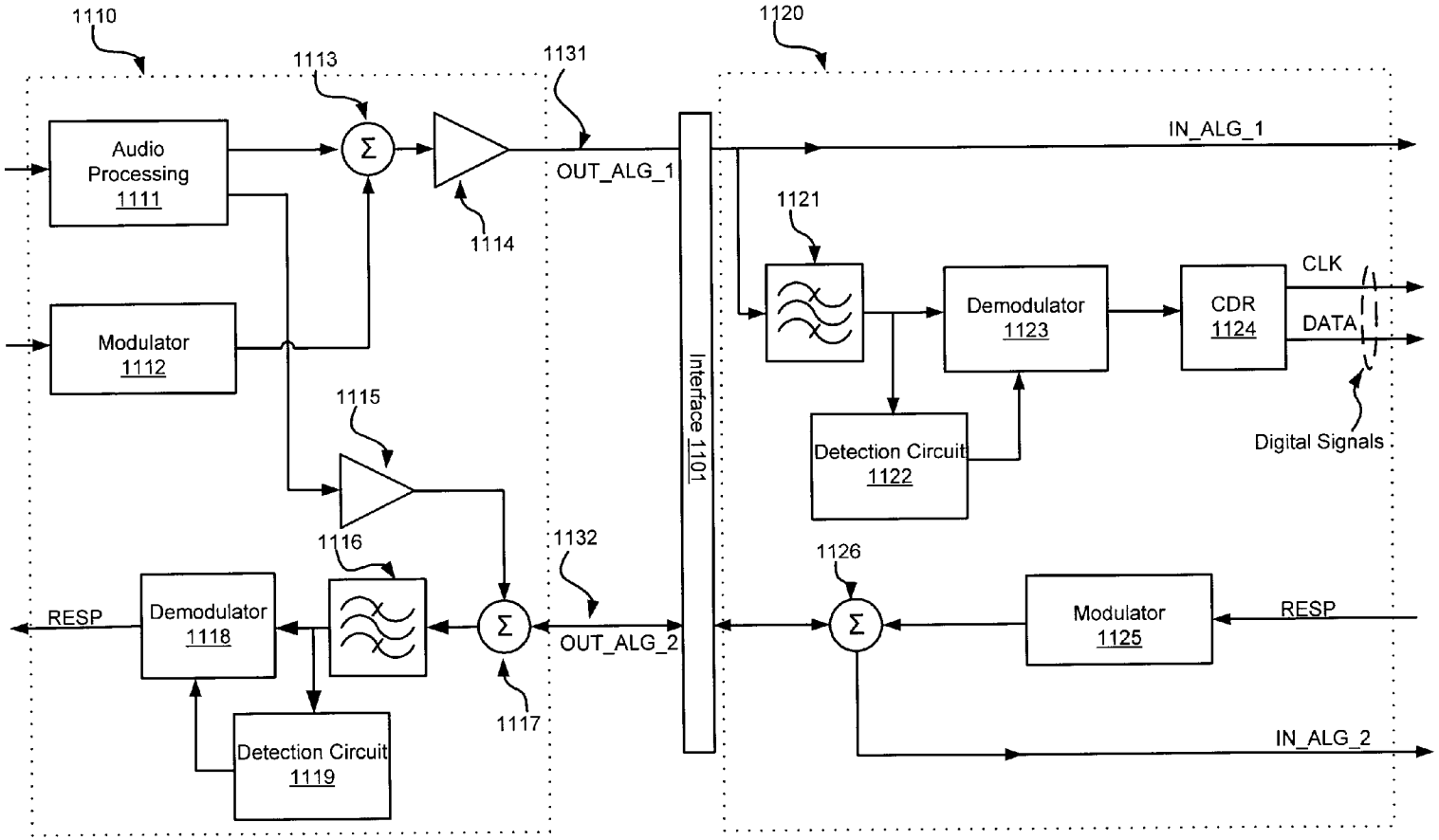
FIG. 11 is a functional block diagram showing yet another embodiment of a programming system I/O circuitry coupled to an extraction circuit.

FIG. 11 is a functional block diagram showing yet another embodiment of a programming system I/O circuitry coupled with an extraction circuit. Programming system I/O circuitry 1110, extraction circuit 1120, and interface 1101 form parts of an acoustic system including a programming system and a set of acoustic headphones. Embodiments shown in FIG. 11 provide a response signal (RESP) which is transferred from the headphones to the programming system. The response signal may contain information relating to the status of various circuitries within the headphones, or debugging data. The extraction circuit 1120 is configurable to receive digital data from the programming system I/O circuit 1110 via a signal line 1131 and to transmit RESP to the programming system via a bi-directional signal line 1132. Bi-directional signal line 1132 transmits both an analog audio signal from the programming system I/O circuitry 1110 and a modulated RESP (a signal generated by modulating carrier wave with RESP) from the extraction circuit 1120. According to an embodiment, the modulated RESP occupies a different frequency range than an analog audio signal also transmitted on signal line 1132.

Programming system I/O circuitry 1110 includes audio processing block 1111, modulator 1112, signal combination elements 1113 and 1117, output buffers 1114 and 1115, filter 1116, detection circuit 1119, and demodulator 1118. Audio processing block 1111 has an input to receive audio data and generates two analog audio signals. Modulator 1112 has an input to receive digital configuration data. Modulator 1112, signal combination element 1113, and output buffer 1114 may operate in a similar manner as described for corresponding elements of FIG. 5, to generate a OUT_ALG__1 (a combined analog and modulated signal) based on a first of the two analog audio signals and the digital configuration data. The second of the two analog audio signals is buffered by output buffer 1115 and transmitted via signal line 1132. Output buffer 1115 transmits the second analog audio signal to signal combination element 1117, which is further coupled to bi-directional signal line 1132. Signal combination element 1117 may output the second analog audio signal to the signal line 1132, concurrently, while receiving other signals transmitted over the signal line 1132. Thus, two or more signal components, each carrying different data or information, may be combined (i.e., propagated at the same time) on the signal line 1132. Filter 1116, which is also coupled to signal line 1122, filters out signals in the audible frequency range, which includes the second analog audio signal. Filter 1116 outputs a signal which, corresponds to the modulated RESP, to both detection circuit 1119 and demodulator 1118. Detection circuit 1119 detects the presence of modulated RESP from the filter 1116 and causes the demodulator 1118 to power up or exit a standby state. Demodulator 1118 demodulates the modulated response signal and provides RESP to additional circuitry within the programming system.

Extraction circuit 1120 contains circuitry to transmit RESP, and includes filter 1121, detection circuit 1122, demodulator 1123, CDR 1124, modulator 1125 and signal combination element 1126. Filter 1121, detection circuit 1122, demodulator 1123, and CDR 1124 may operate in a similar manner as described for corresponding elements of FIG. 5 to generate a first analog audio output signal (IN_ALG__1), digital configuration data (DATA), and a clock signal (CLK) based on OUT_ALG__1 received over signal line 1131. Extraction circuit 1120 further has an input for receiving RESP, which may be a digital signal, from circuitry within the headphones. RESP is transmitted to modulator 1125 which modulates a carrier frequency with RESP to generate the modulated RESP. Modulated RESP is combined with OUT_ALG__2 on signal line 1132 by signal combination element 1117. Modulated RESP signal is propagated over signal line 1132 to the programming system I/O circuitry 1110. The analog audio signal received over signal line 1132 is output as IN_ALG__2.

According to an embodiment, the modulated response signal does not overlap in frequency with the analog audio signal transmitted over signal line 1132. By modulating the response signal to a frequency not used by the analog audio signals, the headphones and programming system may easily separate input and output signals.

According to another embodiment that allows for response signals to be transmitted from the headphones to the programming system, I/O control logic is provided on both the programming system I/O circuitry and the extraction circuit to control the direction of signaling. In a first mode of operation, I/O control logic of the headphones allows analog audio signals to pass from the programming system to the headphones. In a second mode of operation, I/O control logic of the headphones transmits response signals to the programming system. I/O control logic on the headphones may be controlled by registers programmed by digital data, from the programming system, transmitted via the first audio signal line. One value set in the registers causes the I/O control logic to operate in the first mode of operation, while a second value set in the registers causes the I/O control logic to operate in the second mode of operation. According to another embodiment, I/O control logic on the headphones is controlled by carrier detection circuitry within the headphones. The carrier detection circuitry is configured to detect the presence of digital data transmitted from the programming system to the headphones. Upon detecting the digital data, the carrier detect circuitry triggers the I/O control circuitry of the headphones to enter into the second mode of operation. I/O control logic in the programming system may be controlled by a computing device (such as computing device 303 of FIG. 3) coupled to the programming system I/O circuitry.

According to another embodiment, multiple modulated digital signals may be propagated on one signal line between a programming system and a set of headphones. Each modulated digital signal has a different carrier frequency, and is recovered by the receiver with appropriate band-pass filtering.

Figure 12:
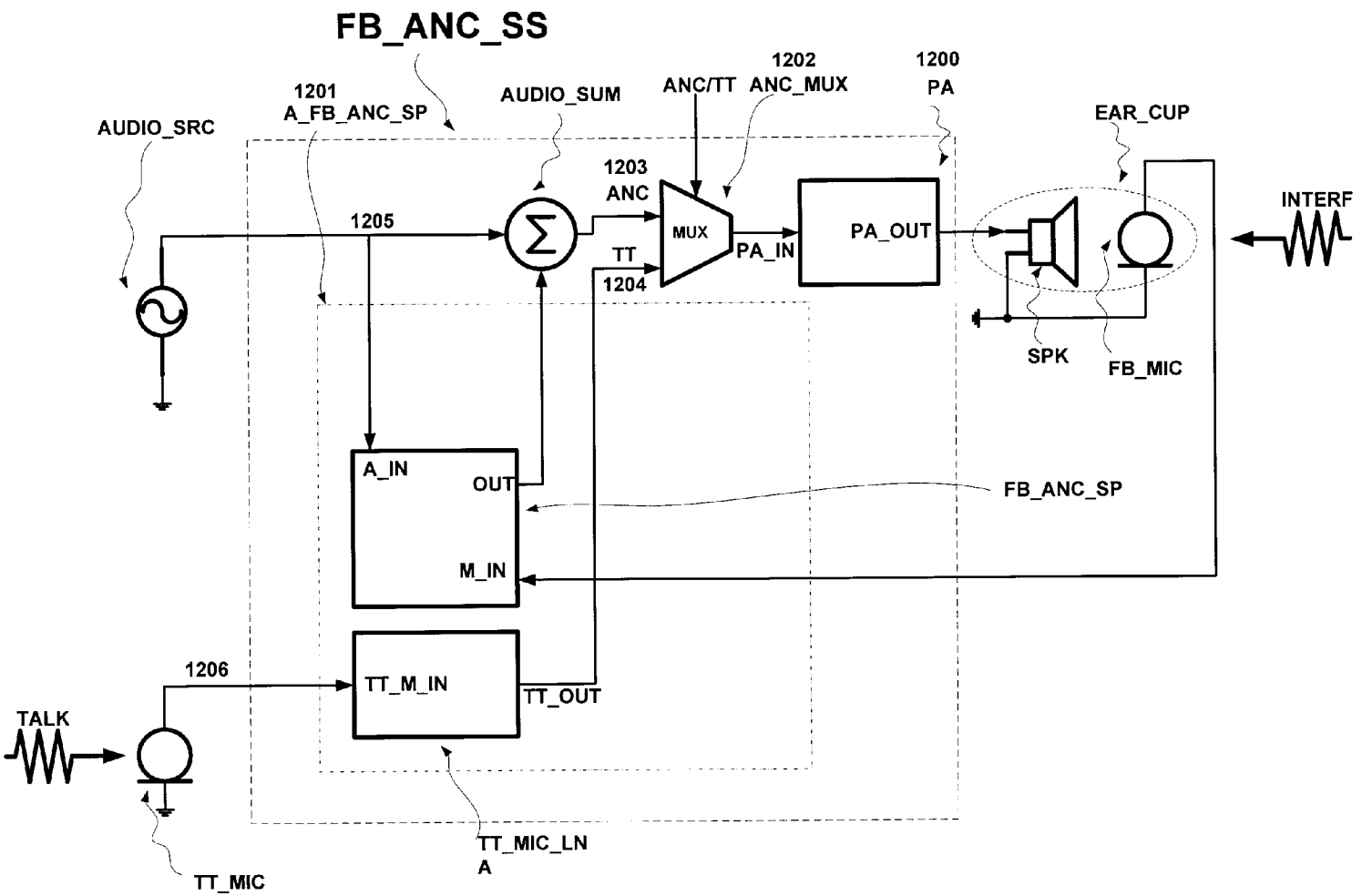
FIG. 12 is a functional block diagram showing an embodiment of an active-noise cancellation (ANC) circuit that achieves audio mute using switches.

In other embodiments of acoustic headphones which include microphones, a "Talk-Through" functionality may be implemented in ANC circuitry. However, while discussed in regards to ANC circuitry within acoustic headphones, Talk-Through functionality may be alternatively implemented on ANC circuitry in stand-alone microphones or in other audio applications. With respect to FIG. 12, when the Talk-Through function is activated, the input audio signal 1205 is supposed to be substantially attenuated, as to allow the Talk-Through microphone signal 1206 to be heard. One way to implement such a feature is to provide a switch in the audio path.

In the particular implementation where the power amplifier 1200 is separated from the ANC signal processor 1201 (as in FIG. 4), an external switch must be provided. The switch is represented as a multiplexer ANC_MUX 1202 controlled by the ANC signal 1203 and the TT signal 1204. The operation of this switch must be carefully timed, in order not to introduce audible clicks. In the same time, the switch resistance should be small and, preferably, linear.

Figure 13:
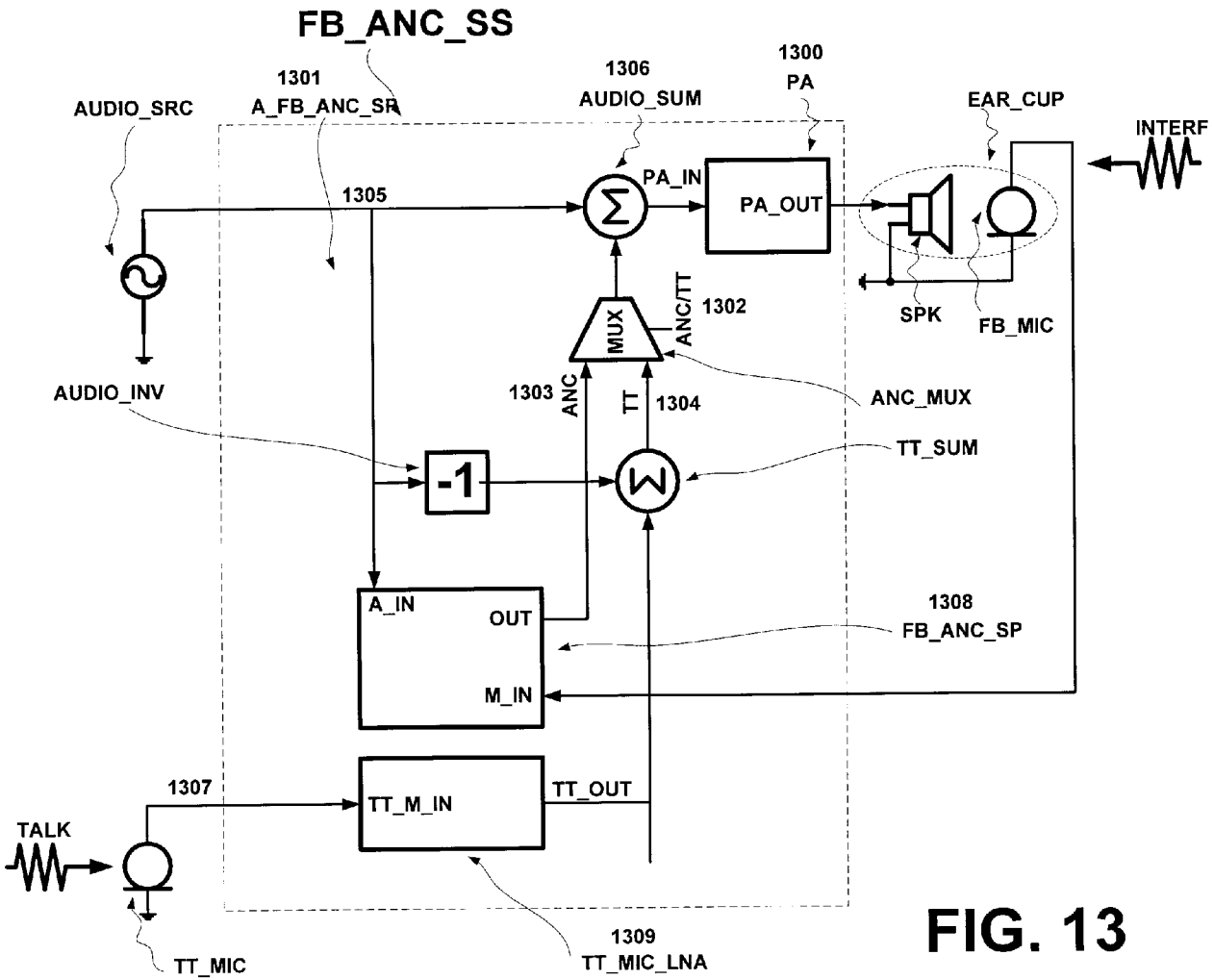
FIG. 13 is a functional block diagram showing another embodiment of an ANC circuit that achieves audio mute via subtraction.

In another embodiment, a local inversion of the AUDIO_IN signal 1305 can be provided inside the ANC signal processor 1301, as shown in FIG. 13.

The processor is configured in the ANC or the Talk-Through mode through the ANC signal 1303 and the TT signal 1304. When the ANC mode is activated, the AUDIO_IN signal 1305 is processed by the A_FB_ANC_SP subblock 1301 and passes through the analog multiplexer ANC_MUX 1302 to the summing block SUM 1306. The signal coming from the Talk-Through microphone 1307 is discarded.

When the Talk-Through mode is activated, the FB_ANC_SP subblock 1308 is disabled, and the analog multiplexer ANC_MUX 1302 passes to the summing block SUM 1306 the inverted version of the AUDIO_IN signal 1305, combined with the output of the programmable gain amplifier TT_MIC_LNA 1309. Depending on the quality of the analog blocks involved, a substantial attenuation of the audio signal can be achieved.

Figure 14:
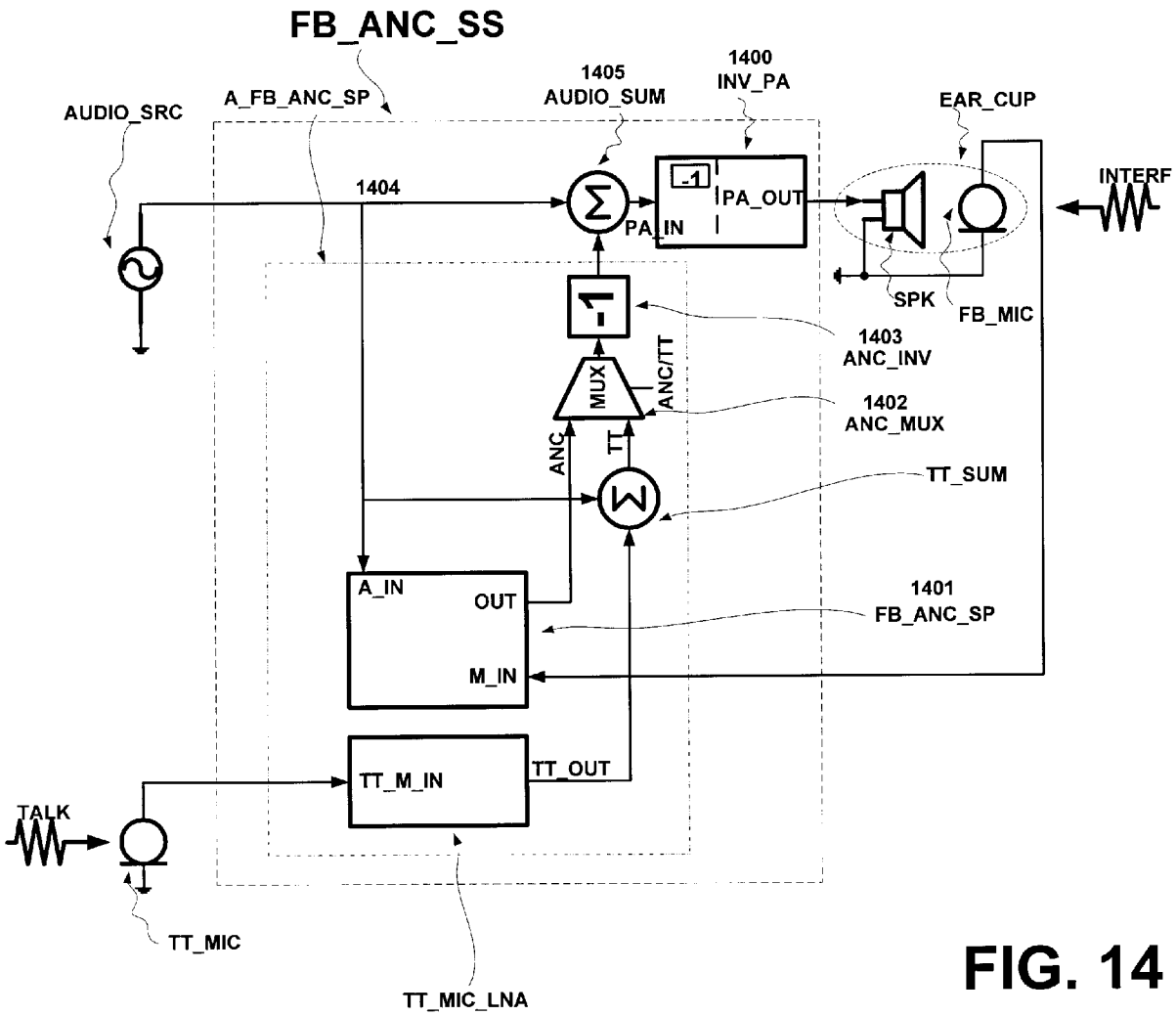
FIG. 14 is a functional block diagram showing yet another embodiment of an ANC circuit that achieves audio mute via subtraction.

An alternative implementation is shown in FIG. 14. This implementation is closer to the physical realization of such an ANC, where using op amp based inverting gain stages is, most of the time, preferable, for instance, for lower distortion reasons. The circuit of FIG. 14 uses an inverting power amplifier INV_PA 1400. In the ANC mode, the output signal of the FB_ANC_SP block 1401 passes through the ANC_MUX multiplexer 1402, it is inverted by the ANC_INV block 1403 and it is added to the AUDIO_IN input signal 1404 by the AUDIO_SUM summing block 1405. The output of the AUDIO_SUM block 1405 is applied to the inverting power amplifier INV_PA 1400. Overall, because of the double inversion happening in the ANC_INV stage and in the INV_PA power stage, the phase characteristic of the noise cancelling feedback system is preserved.

Figure 15:
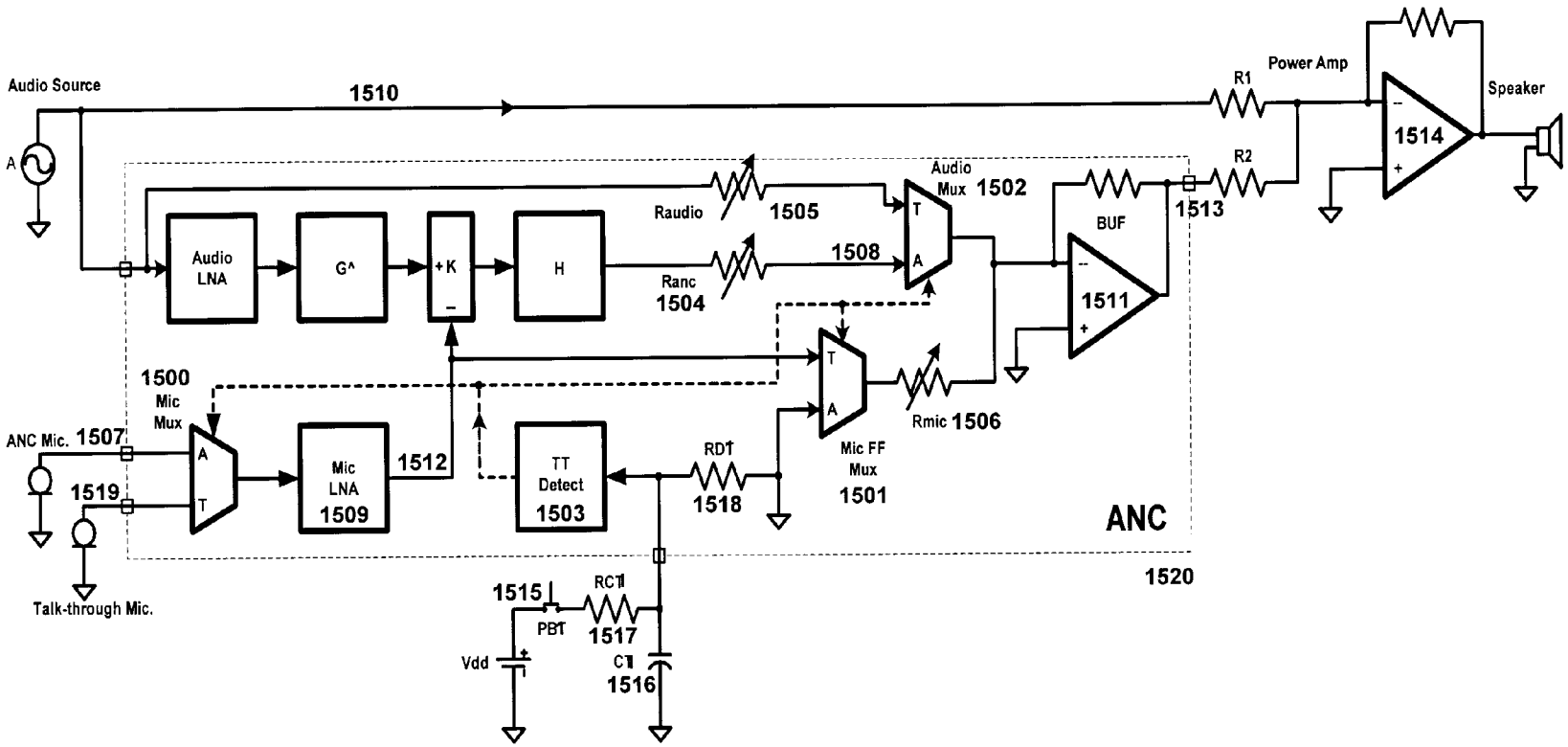
FIG. 15 shows an embodiment of the ANC circuit of FIG. 14.

A particular way of implementing the solution presented in FIG. 14 is shown in FIG. 15. The circuit of FIG. 15 is a feedback ANC augmented with three analog multiplexers (Mic Mux 1500, Mic FF Mux 1501, Audio Mux 1502), a Talk-Through Detect block 1503 and three digitally controlled, time-dependent resistors (Ranc 1504, Raudio 1505, Rmic 1506).

In the normal operation mode (ANC Mode), the Mic Mux 1500 selects the ANC Mic signal 1507, the Audio Mux 1502 selects the H filter output signal 1508 and the Mic FF Mux 1501 connects the Rmic resistor 1506 to ground.

In the Talk-Through operation mode, the Auxiliary Microphone is connected to the input of the Mic LNA 1509, the Audio input 1510 is connected through the Raudio resistor 1505 to the summing node of the BUF op amp 1511, and the Mic LNA output 1512 is connected to the summing input of the BUF op amp 1511 through the Rmic resistor 1506. The audio signal is inverted at the ANC output by the BUF output amplifier 1511. The direct audio input 1510 and the ANC output signals 1513 are added by the external power amplifier 1514. The audio input signal components ideally cancel at the summing node of the power amplifier 1514.

In order to have a smooth transition between the ANC 1520 and the Talk-Through Modes, a TT Detect circuit is provided. When the PBT push-button 1515 is pressed, The capacitor C1 1516 starts charging through the combination of RC1 1517 and RD1 1518. The voltage on the capacitor is monitored by the TT Detect block 1503. Function of the evolution in time of the voltage across the capacitor C1 1516, the value of the resistors Raudio 1505, Ranc 1504 and Rmic 1506 will change in such a way as to provide a graded transition between the modes.

When the Talk-Through mode is activated, the Mic Mux 1500 is switched to the Talk-Through Mic 1519, breaking the ANC feedback loop. The MicFF Mux 1501 is switched to the Mic LNA output 1512 and the Audio Mux 1502 is switched to the Raudio 1505 line. Initially, Raudio 1505 and Rmic 1506 are much larger than the feedback resistor of BUF 1511, keeping the gain of the BUF output amplifier low. Gradually, Rmic 1506 and Raudio 1505 are reduced, increasing the contribution of the microphone signal to the speaker output and increasing the amount of the inverted audio signal injected at the power amplifier 1514 summing node.

When the Talk-Through push button is released, the capacitor C1 1516 will discharge through the internal resistor RD1 1518, and the above mentioned process is gradually reversed.

While particular embodiments of the present invention have been shown and described, it will be obvious to those skilled in the art that changes and modifications may be made without departing from this invention in its broader aspects, and therefore, the appended claims are to encompass within their scope all such changes and modifications as fall within the true spirit and scope of this invention.

What is claimed is:

1. A set of headphones for producing an acoustic signal characterized by first and second channel audio signals, the set of headphones comprising:

a number of speakers;

an interface configured to receive an analog input signal including the acoustic signal and configuration programming data generated such that the configuration programming data is combined with the first channel audio signal, the interface including:

a first channel input configured to receive the first channel audio signal combined with the configuration programming data; and a bi-directional input/output configured to receive the second channel audio signal and to transmit a status signal;

an audio processing circuit coupled to receive the first channel and second channel audio signals and configured to output the acoustic signal to the speakers, wherein the audio processing circuit is responsive to a programming signal to program programmable audio processing functionality that characterizes a configuration of the audio processing circuit for processing the acoustic signal;

an extraction circuit having an input to receive the first channel audio signal combined with the configuration programming data and configured to extract the configuration programming data;

a configuration circuit having an input to receive the configuration programming data and having an output to provide the configuration programming data as the programming signal to the audio processing circuit; and a bi-directional communication circuit coupled to the bi-directional input/output, including:

a bi-directional signal combination circuit configured to receive the second channel audio signal from the bi-directional input/output and to provide the status signal to the bi-directional input/output; and a modulator circuit having an input coupled to receive headphone data representative of selected headphone circuitry parameters, and configured to provide the status signal embodying the headphone data to the bi-directional signal combination circuit.

2. The set of headphones of claim 1, wherein the configuration circuit includes storage circuitry configured to store configuration programming data, and configuration circuitry configured to provide the programming signal corresponding to the stored configuration programming.

3. The set of headphones of claim 1, wherein the first channel audio signal is embodied entirely in a first frequency range of the analog input signal and the configuration programming data is embodied entirely in a second frequency range of the analog input signal.

4. The set of headphones of claim 3, wherein the configuration programming data is embodied in the analog input signal as a modulated digital signal.

5. The set of headphones of claim 1, wherein the acoustic signal and the configuration programming data are provided as time-multiplexed signals within the analog input signal.

6. The set of headphones of claim 1, wherein the extraction circuit comprises:

a demodulator circuit having a first input to receive at least the first channel analog signal combined with the configuration programming data, and having an output to produce a digital data signal embodying the configuration programming data; and a clock and data recovery circuit having an input to receive the digital data signal and having an output to generate the configuration programming data and a clock signal.

7. The set of headphones of claim 6:

wherein the demodulator circuit includes a control input to receive an enable signal;

wherein the extraction circuit further comprises a detection circuit having an input to receive at least the first channel analog signal combined with the configuration programming data, and having an output to generate the enable signal when configuration programming data is detected.

8. The set of headphones of claim 5, wherein the extraction circuit comprises:

a de-multiplexer circuit having an input to receive at least the first channel audio signal combined with the configuration programming data, and a control input to receive a select signal;

a detection circuit having an input to receive at least the first channel audio signal combined with the configuration programming data, and having an output to generate the select signal;

wherein the de-multiplexer circuit is responsive to the select signal to output in a respective time slot either the acoustic signal or a digital data signal embodying the configuration programming data; and a clock and data recovery circuit having an input to receive the digital data signal and having an output to generate the configuration programming data and a clock signal.

9. The set of headphones of claim 1:

wherein the audio processing circuit includes automatic noise cancellation (ANC) circuitry and wherein the programmable audio processing functionality includes ANC operations performed by the ANC circuitry.

* * * * *